US006601597B2

(12) United States Patent
Sung

(10) Patent No.: US 6,601,597 B2
(45) Date of Patent: Aug. 5, 2003

(54) WINDBREAK AND AIR-VENTILATING FOLDING UMBRELLA

(76) Inventor: Sun-Feng Sung, No. 118, Sec. 2, Chang-Tsao Rd., He-Mei Chen, Changhua-Hsien (TW)

( * ) Notice: Subject to any disclaimer, the term of this patent is extended or adjusted under 35 U.S.C. 154(b) by 0 days.

(21) Appl. No.: 09/945,645

(22) Filed: Sep. 5, 2001

(65) Prior Publication Data

US 2003/0041888 A1 Mar. 6, 2003

(51) Int. Cl.[7] ..... A45B 25/20
(52) U.S. Cl. ..... 135/33.7; 135/33.2; 135/29
(58) Field of Search ..... 135/33.7, 33.5, 135/33.2, 25.3, 31, 32, 33.41, 27, 29, 33.71, 16, 37, 15.1

(56) References Cited

U.S. PATENT DOCUMENTS 5,078,166 A * 1/1992 Lee ..... 135/33.7
5,601,103 A * 2/1997 Dubinsky ..... 135/33.7
6,006,770 A * 12/1999 Lin et al. ..... 135/33.7
6,095,171 A * 8/2000 Lin et al. ..... 135/33.7
6,173,723 B1 * 1/2001 Wang ..... 135/31
6,237,616 B1 * 5/2001 You ..... 135/33.7
6,502,592 B2 * 1/2003 Chen ..... 135/33.7

* cited by examiner

*Primary Examiner*—Janet M. Wilkens
(74) *Attorney, Agent, or Firm*—Birch, Stewart, Kolasch & Birch, LLP

(57) ABSTRACT

A windbreak and air-ventilating folding umbrella includes a frame coupling with a linkage bar. The linkage bar has one end attached to a sleeve which is movable on the frame and another suspended to allow the linkage bar having open or close movement at the suspended end. The sleeve is formed in C-shape. There is an upper panel fastened to an anchor cap of the umbrella and the suspended end of the linkage bar, and a lower panel fastened to the rib of the umbrella. The upper panel and the lower panel have respectively a portion overlapped with each other. The umbrella thus constructed can shelter rainfall and shield sunshine, and also facilitate air ventilation, thus can prevent the umbrella from overturning in the strong wind, and is adaptable for ordinary or folding umbrellas.

3 Claims, 5 Drawing Sheets

WINDBREAK AND AIR-VENTILATING FOLDING UMBRELLA

FIELD OF THE INVENTION

The present invention relates to an umbrella and particularly a folding umbrella that is windbreak and allows air ventilation to prevent the umbrella from overturning by strong wind.

BACKGROUND OF THE INVENTION

The commonly used umbrellas and parasols generally have the umbrella panel (fabric) fixedly attached to the ribs and supported by a center shaft for extending or retracting. Their function are mainly to shelter people from rainfall or sunshine.

While the umbrella may function properly under normal circumstances, when using in strong wind, the fixed umbrella panel or fabric is prone to overturn by strong gusts, and could cause users getting wet in the rain. It is an awkward and unpleasant situation many people have experienced and try to avoid.

On the other hand, when using parasols to shield strong sunshine, the fixedly mounted umbrella panel tends to gather and trap hot air under the top of the parasol and hinder air convection. Hot air is difficult to ventilate or disperse. It becomes sultry or sweltering for people under the parasol. All this indicates that there are still rooms for improvement.

SUMMARY OF THE INVENTION

In view of the foregoing disadvantages, the primary object of the invention is to provide an improved umbrella structure that has an upper panel and a lower panel with a gap formed therebetween to offer rainfall and sunshine sheltering function and air ventilation effect.

Another object of the invention is to provide an umbrella that has an upper panel and a lower panel with a gap formed therebetween to diffuse strong gusts without overturning the umbrella.

Still another object of the invention is to provide a reinforced umbrella structure adaptable for use on folding umbrellas.

The umbrella of the invention mainly includes a linkage bar coupling to the rib. The linkage bar has one end attached to a sleeve which is slidable on the rib and another end suspending to form an open or closed condition. The sleeve is formed in C-shape to couple with the rib. The suspending end of the linkage bar and the anchor cap of the umbrella are used to support an upper panel, while the rib of the umbrella is used to support a lower panel which has a section overlapped with the upper panel. Such a construction can shelter rain and sunshine as usual, also provides air ventilation effect, and can withstand strong wind and gusts without overturning. The construction can also be adapted for folding umbrellas.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
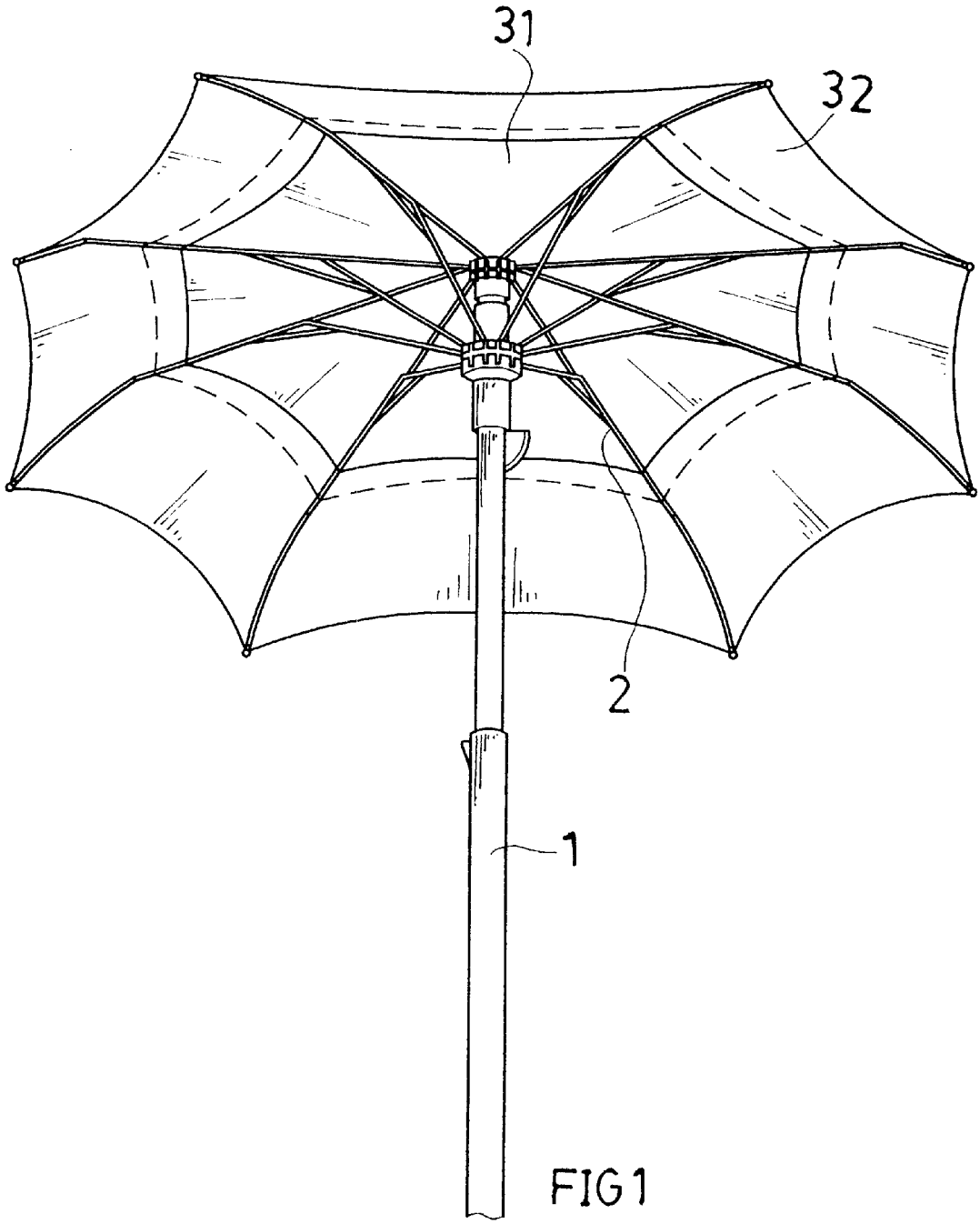
FIG. 1 is a pictorial view of a first embodiment of the invention.

Referring to FIGS. 1 through 4B, the invention mainly includes a center shaft 1 coupling with a frame 2 and an umbrella panel 3 fastening to the frame 2.

The center shaft 1 is coupled with a runner 11, a movable ring 12 and an anchor cap 13. There is a spring 14 located between the runner 11 and the movable ring 12 to keep the movable ring 12 and the anchor cap 13 spaced from each other for a selected distance.

The frame 2 has one end engaged with the runner 11 and movable ring 12, and another end engaged with a rib 21 at a selected location. The rib 21 has one end engaged with the anchor cap 13 and another end suspending. Adjacent to the juncture of the rib 21 and frame 2, there is a linkage bar 22 made of an elastic material coupled thereon. The linkage bar 22 has one end formed a C-shaped sleeve 221 coupling to the rib 21 (the C-shaped sleeve 221 has an interior diameter substantially same as the diameter of the rib 21 and a slot opening smaller than the radial width of the rib 21 for preventing the sleeve 221 from separating from the rib 21) and another end suspending. The rib 21 further has a plurality of notches 211 to restrict the moving range of the sleeve 221 on the rib 21.

The umbrella panel 3 includes an upper panel 31 and a lower panel 32. The upper panel 31 is fastened to the anchor cap 13 and linkage bar 22, while the lower panel 32 is fastened to the linkage bar 22. The upper panel 31 and the lower panel 32 have a portion overlapped with each other. Hence when using in rain, rainfall will be prevented from falling through the umbrella. Through the linkage bar 22, there is a gap between the upper panel 31 and the lower panel 32 to allow hot air to escape.

Figures 2A, 2B:
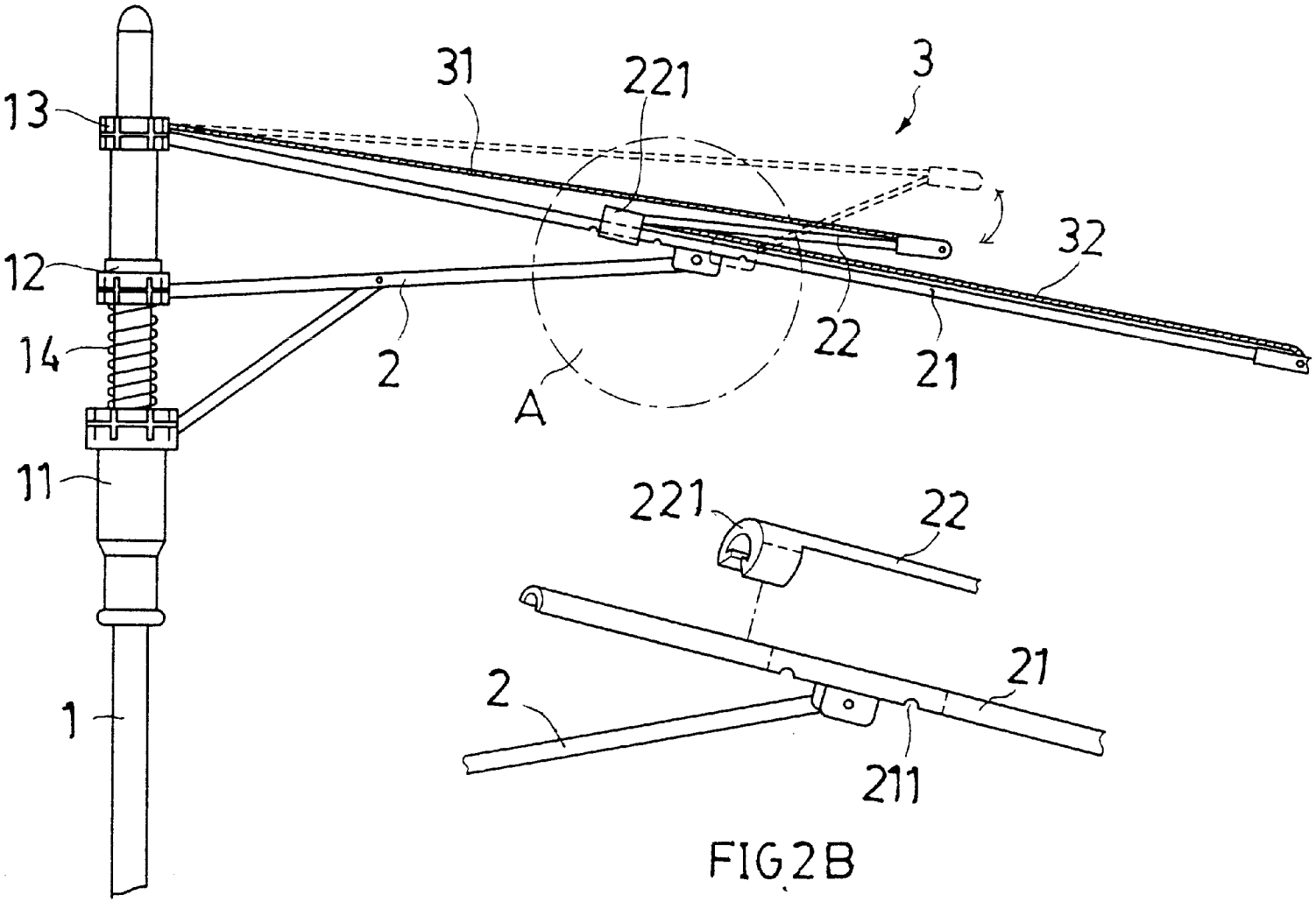
FIG. 2A is a fragmentary schematic view of a first embodiment of the invention.
FIG. 2B is a fragmentary exploded view of the portion A in FIG. 2A.

When use in the circumstances of strong wind, wind blowing under the umbrella panel 3 will flow towards the upper panel 31 and result in sliding of the linkage bar 22 (as shown in FIG. 2A, by broken lines). The gap between the upper panel 31 and the lower panel 32 will be increased for wind to pass and blow away. When the wind is weaker, the elastic force of the linkage bar 22 will move the linkage bar 22 to its original position, and restore the upper panel 31 and the lower panel 32 to close the gap. Hence by means of the sliding and elastic force of the linkage bar 22, the upper panel 31 may generate an extending or closing movement to prevent the umbrella from overturning.

Figures 3A, 3B:
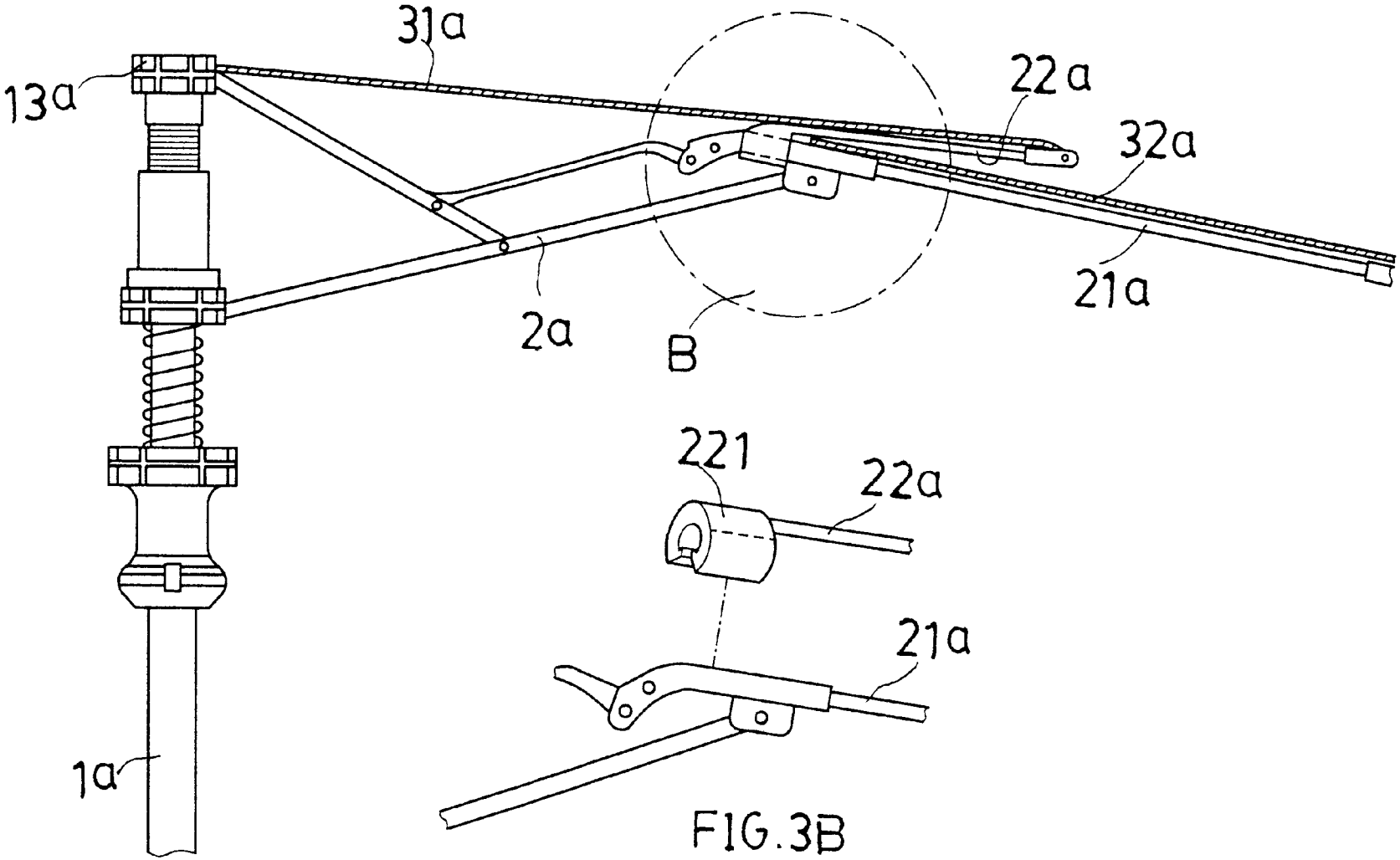
FIG. 3A is a fragmentary schematic view of a second embodiment of the invention.
FIG. 3B is a fragmentary exploded view of the portion B in FIG. 3A.

Referring to FIG. 3A for another embodiment of the invention adapted for a two-way folding umbrella, the linkage bar 22*a* is coupled with one end of a rib 21*a* (shown in FIG. 3B). The upper panel 31*a* is also fastened to the anchor cap 31*a* and linkage bar 22*a*, while the lower panel 32*a* is fastened to the rib 21*a*. There is also a gap between the upper panel 31*a* and the lower panel 32*a* to allow hot air to escape. And the sliding and elastic force of the linkage bar 22*a* also allow the upper panel 31*a* having extension or closing movement to prevent the umbrella from overturning.

Figure 4A:
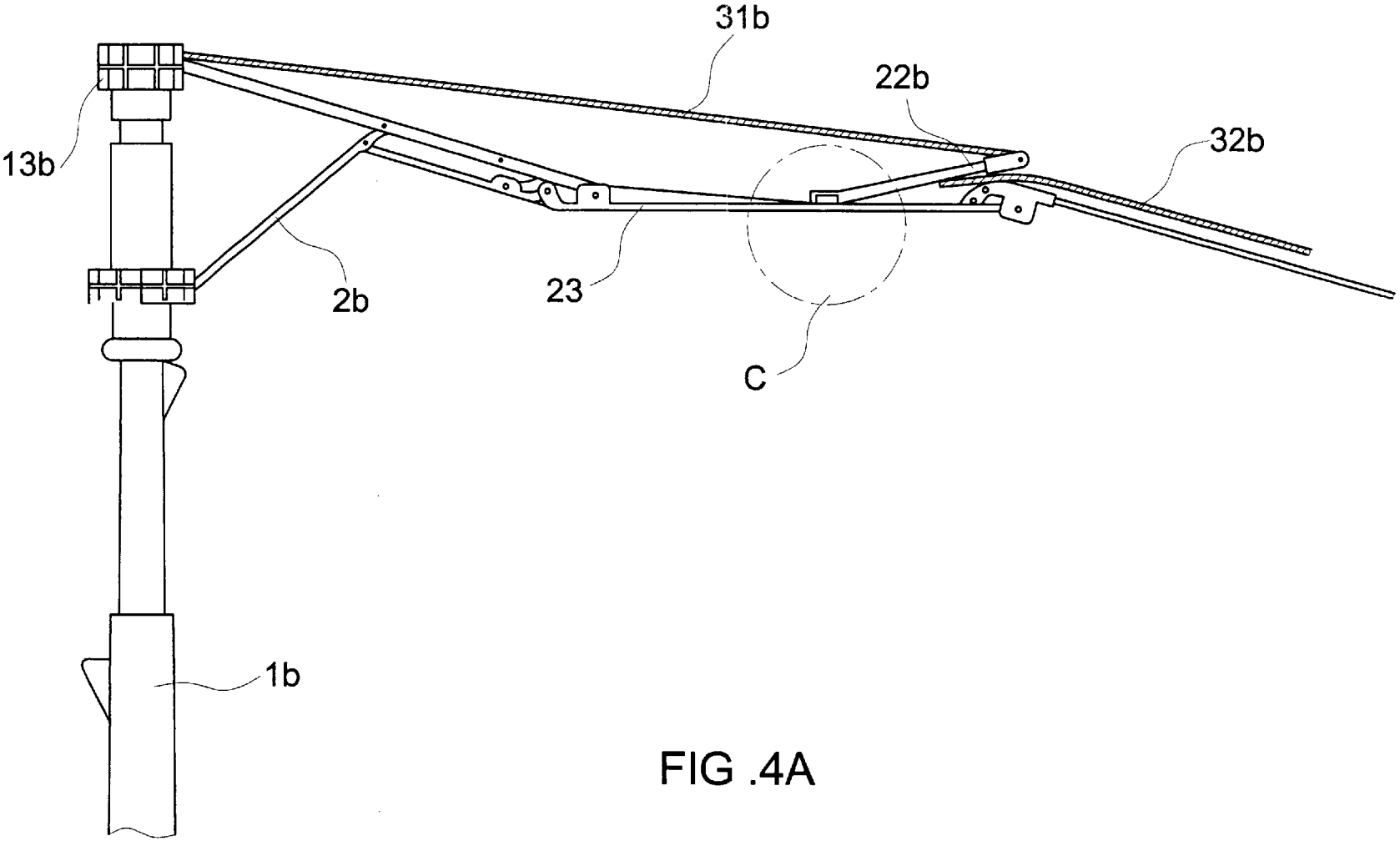
FIG. 4A is a fragmentary schematic view of a third embodiment of the invention.
Figure 4B:
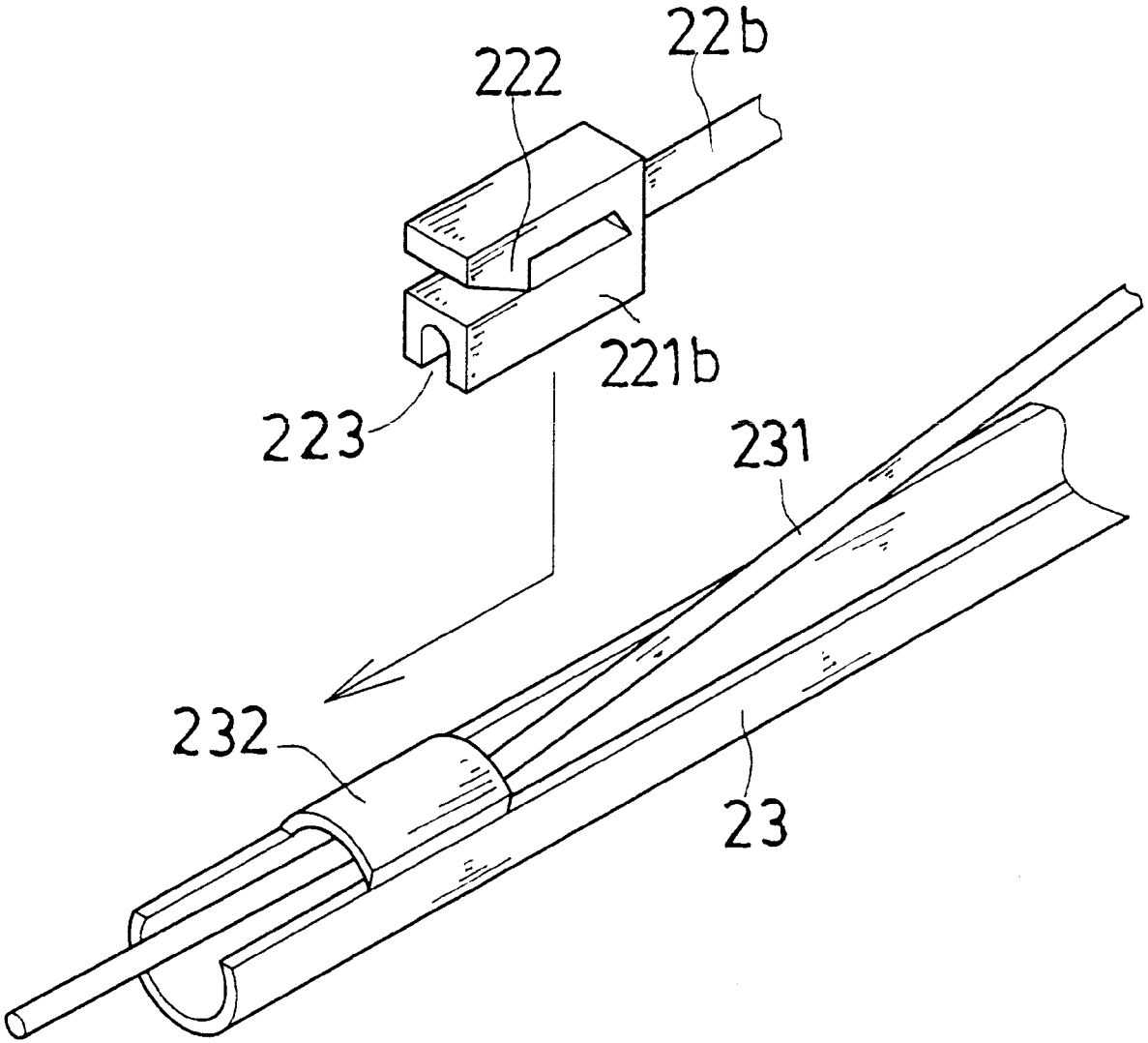
FIG. 4B is a fragmentary exploded view of the portion C in FIG. 4A.

Referring to FIG. 4A for yet another embodiment of the invention adapted for a three-way folding umbrella, the frame 2*b* engages with a stretcher 23 which has an anchor flap 232 bent and mounted thereon. The sliding sleeve 221*b* has a hook 222 to engage with the anchor flap 232 and a trough 223 located below the hook 222 for the rib 231 to pass through (as shown in FIG. 4B). The upper panel 31*b* is also fastened to the anchor cap 13*b* and linkage bar 22*b*, while the lower panel 32*b* is fastened to the linkage bar 22*b*. Again, through the linkage bar 22*b*, there is a gap between the upper panel 31*b* and the lower panel 32*b* to allow hot air to escape. And the sliding and elastic force of the linkage bar 22*b* also allow the upper panel 31*b* having extension or closing movement to prevent the umbrella from overturning.

In summary, the invention has the following advantages:

1. The invention does not need to change the structure of the original umbrella frame. Merely adding a linkage bar to the existing umbrella can achieve the object and function desired. It can be reduce redesign and production costs, and is adaptable for mass production.
2. The invention provides an upper panel and a lower panel which have a portion overlapped and form a gap therebetween. Such a structure can shelter rainfall and also facilitate discharging of hot air.
3. The sliding movement and elastic force of the linkage bar allow the upper panel to open or close, therefore can prevent the umbrella from overturning.
4. The construction of the linkage bar and upper and lower panel is adaptable for ordinary or folding umbrellas.

What is claimed is:

1. A windbreak and air-ventilating folding umbrella, comprising:

a center shaft having an anchor cap and a ring mounted thereon;

a frame coupled with the ring and a rib or stretcher, a linkage bar having one end attached to a sleeve to allow the linkage bar to move freely on the rib or stretcher and another end suspended to allow the linkage bar to have opening or closing movement at the suspended end thereof;

an upper panel fastened to the anchor cap and the suspended end of the linkage bar; and a lower panel fastened to the rib, the upper panel and the lower panel having respectively a portion overlapped with each other.

2. The windbreak and air-ventilating folding umbrella of claim 1, wherein the sleeve is formed in C-shape, the rib having a plurality of notches for limiting the moving range of the sleeve on the rib.

3. The windbreak and air-ventilating folding umbrella of claim 1, wherein the frame engages with the stretcher which has an anchor flap mounted thereon, the sleeve having a hook to engage with the anchor flap and a trough formed below the hook for the rib to pass through.

* * * * *